United States Patent [19]

Lacasa et al.

[11] Patent Number: 4,458,838

[45] Date of Patent: Jul. 10, 1984

[54] FOLDING CONTAINER

[76] Inventors: Jaime Lacasa; Judith N. Lacasa, both of 2617 Cleveland Dr., Ames, Iowa 50010

[21] Appl. No.: 461,142

[22] Filed: Jan. 26, 1983

[51] Int. Cl.[3] ..... B65D 5/28; B65D 5/42; B65D 5/66

[52] U.S. Cl. ..... 229/33; 220/415; 220/453; 229/44 R

[58] Field of Search ..... 220/415, 441, 468, 443, 220/453; 229/33, 36, 44 R

[56] References Cited

U.S. PATENT DOCUMENTS

| | | | |
|---|---|---|---|
| 562,682 | 6/1896 | Webb | 229/33 |
| 610,255 | 9/1898 | Bisler | 229/33 |
| 922,334 | 5/1909 | Regenstein | 229/33 |
| 1,072,487 | 9/1913 | Morton | 229/33 |
| 1,196,365 | 8/1916 | Jennings | 229/33 |
| 1,713,087 | 5/1929 | Nelson | 229/33 X |
| 1,810,956 | 6/1931 | Frankenstein | 229/33 X |
| 1,938,501 | 12/1933 | Shofer | 229/33 |
| 2,088,315 | 7/1937 | Zalkind . | |
| 2,548,001 | 4/1951 | Butterfill | 229/33 X |
| 2,727,675 | 12/1955 | Mairs et al. | 229/30 X |
| 2,750,098 | 6/1956 | Levkoff | 229/30 X |
| 2,797,854 | 7/1957 | Myers et al. | 229/30 |
| 3,784,082 | 1/1974 | Hurlock | 229/30 |
| 3,899,119 | 8/1975 | Roccaforte | 229/33 X |
| 4,201,330 | 5/1980 | Gilbert | 229/33 |
| 4,291,830 | 9/1981 | Sorensen | 229/33 R X |
| 4,304,351 | 12/1981 | Stollberg | 229/44 R X |

FOREIGN PATENT DOCUMENTS

| | | | |
|---|---|---|---|
| 1903982 | 9/1969 | Fed. Rep. of Germany | 229/33 |
| 1424594 | 12/1966 | France | 229/33 |
| 1538376 | 9/1968 | France | 229/33 |
| 714466 | 8/1954 | United Kingdom | 229/33 |

*Primary Examiner*—Allan N. Shoap

*Attorney, Agent, or Firm*—Zarley, McKee, Thomte, Voorhees & Sease

[57] ABSTRACT

The folding container of the present invention comprises a polygonal container, one embodiment of which is a rectangular box having a bottom wall, a top wall, a rear wall, a front wall and two opposite side walls. The two opposite side walls each include three spaced apart panels which form front and rear inner slots and an outer slot therebetween. Flaps from the opposite ends of the front and rear walls extend within the front and rear slots, respectively, and downwardly extending flaps from the top wall extend into the outer slots in the lateral sidewalls. The front wall includes two spaced apart panels, and a flap from the top wall extends downwardly into the space between the two panels of the front wall.

7 Claims, 7 Drawing Figures

FOLDING CONTAINER

BACKGROUND OF THE INVENTION

This invention relates to a folding container.

One problem encountered with shipping containers is the requirement that the container be capable of withstanding numerous forces and pressures during shipment. Many containers collapse in response to the rigors of handling and transportation.

Another important requirement for shipping containers is the ability of the container to provide the maximum strength with the minimum amount of weight. Preferably the container should be constructed of paperboard or some other light material.

Another problem encountered with shipping containers is the necessity for storing the containers when they are not being used. The preferred manner for doing this is to provide a foldable container which is flat during nonuse, but which can be rapidly and easily folded into the desired shape for use.

A further problem encountered in shipping containers is the requirement that the shipping container be secure during shipment. Many containers fall apart or become opened during shipment.

Therefore, a primary object of the present invention is the provision of an improved folding container.

A further object of the present invention is the provision of a folding container which is light in weight.

A further object of the present invention is the provision of a folding container which is sufficiently strong to withstand the forces encountered during shipping, handling and storing.

A further object of the present invention is the provision of a folding container which can be maintained in a flat state for storage, but which can be folded rapidly and easily to provide the desired shipping container.

A further object of the present invention is the provision of a folding container which is economical to manufacture, durable in use, and efficient in operation.

SUMMARY OF THE PRESENT INVENTION

The present invention utilizes a folding container which is polygonal in shape. One embodiment is a rectangular container which includes a top wall, a bottom wall, a rear wall, a front wall and two opposite lateral side walls.

The lateral sidewalls each include three panels which are held apart by spacers therebetween so as to form an inner space and an outer space therebetween. The inner space is adapted to receive locking flaps positioned at the ends of the rear wall and the front wall, respectively. The outer space of the lateral side walls is adapted to receive the downwardly extending flaps at the lateral sides of the top wall. The front wall of the shipping container is comprised of two panels held apart by a spacer therebetween. The space between these two panels of the front wall receives a downwardly extending flap, extending from the front edge of the top wall.

The container is easy to assemble and fold into the desired configuration. It can be made of any size and because of its multi-panel construction, it is very sturdy so as to resist crushing or breaking or opening during shipment.

DETAILED DESCRIPTION OF THE PREFERRED EMBODIMENT

Figure 1:
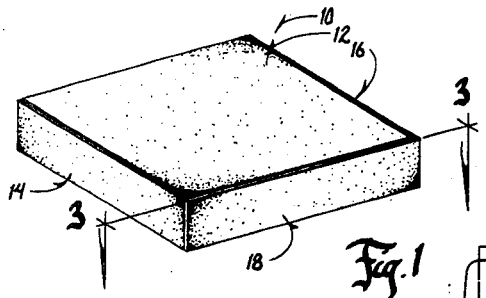
FIG. 1 is a perspective view of a rectangular folding container of the present invention.

Referring to the drawings, the numeral 10 generally designates one embodiment of the folding container of the present invention. Container 10 is rectangular in shape and includes a top wall 12, two opposite side walls 14, 16, a front wall 18, a rear wall 20, and a bottom wall 22.

Bottom wall 22, rear wall 20, and top wall 12 are all of single panel construction and are integral with one another. Top wall 12 includes a pair of top wall side flaps 24, 26 and a top wall front flap 28.

Rear wall 20 has at its opposite ends a pair of rear wall locking flaps 30, 32.

Figure 2:
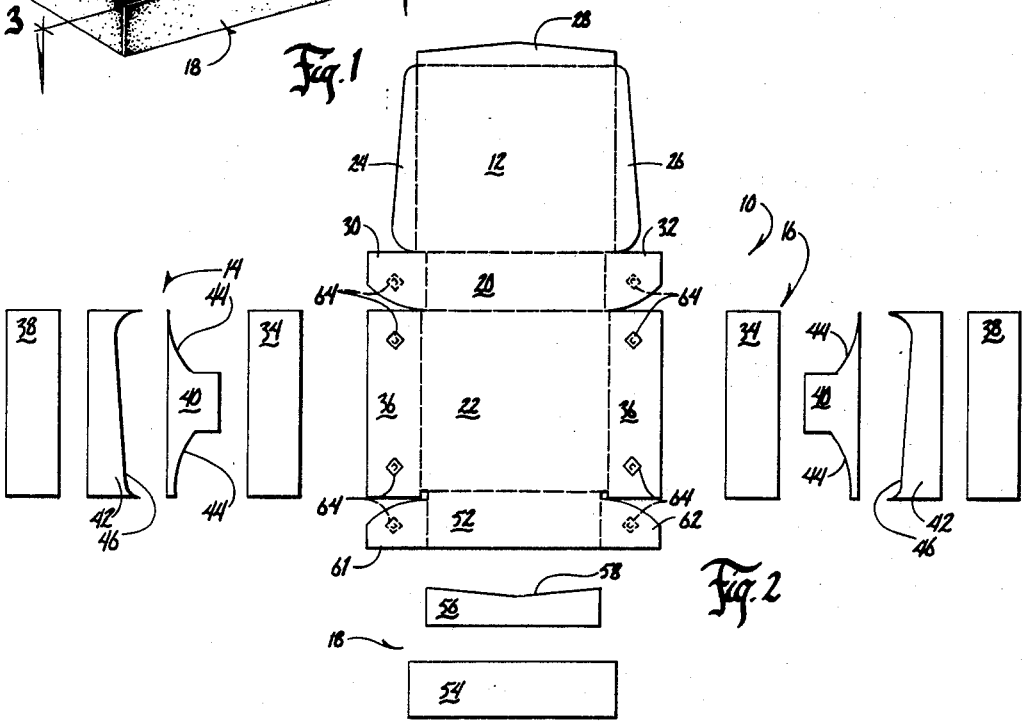
FIG. 2 is a plan view of all of the various components of the rectangular container prior to affixation of the loose members to the main body of the container by the manufacturer.
Figure 3:
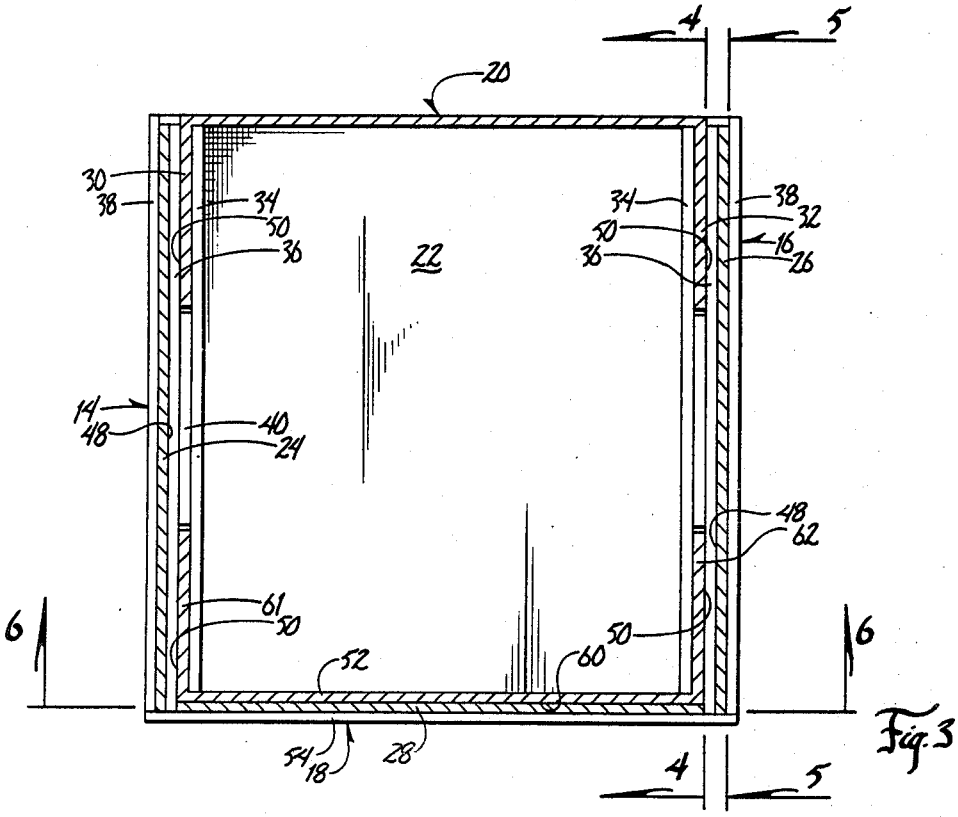
FIG. 3 is a sectional view taken along line 3—3 of FIG. 1.
Figure 7:
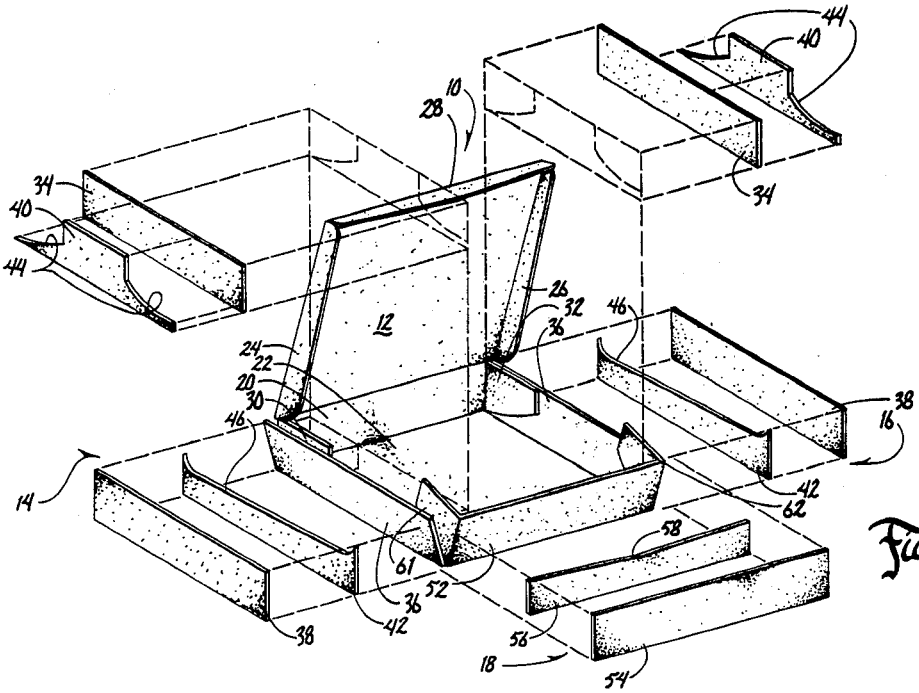
FIG. 7 is a perspective exploded view of a rectangular container of the present invention showing the various components thereof.

Side walls 14, 16 are each comprised of an inner side wall panel 34, a central side wall panel 36, and an outer side wall panel 38. Central panel 36 is integral with bottom wall 22 as can readily be seen in FIG. 2. An interior spacing member 40 is positioned between inner panel 34 and central panel 36, and an exterior spacing member 42 is between central panel 36 and outer panel 38. Interior spacing member 40 includes cut-outs or notches 44 therein shaped to receive flaps 30, 32 of rear wall 20, and exterior spacing member 42 includes an upwardly presented slot or cut-out 46 which is shaped to receive the flaps 24, 26 of top wall 12. Panels 34, 36, 38 are secured together in spaced apart relationship with spacing members 40 and 42 interposed therebetween as shown in FIG. 7. This construction results in an exterior slot 48 being formed between panels 36, 38 and an interior slot 50 being formed between interior panel 34 and central panel 36.

Front wall 18 comprises an inner front wall panel 52 and an outer front wall panel 54 which are spaced apart from one another by a spacer member 56. Spacer member 56 includes a cut-out portion 58 adapted to mate with front flap 28 of top wall 12. Spacer 56 provides a front slot 60 between front panels 52, 54 for receiving front flap 28 of top wall 12. Inner front panel 52 is integral with bottom wall 22 and includes at its opposite ends a pair of locking flaps 61, 62 which are similar in shape to flaps 30, 32 of rear wall 20.

In manufacturing the container 10, panels 34, 36, 38 and spacer members 40, 42 are secured together by gluing or the like in the spaced apart relation described above. Similarly interior panel 52, exterior panel 54 and spacer member 56 are glued together in the arrangement described above.

Figure 4:
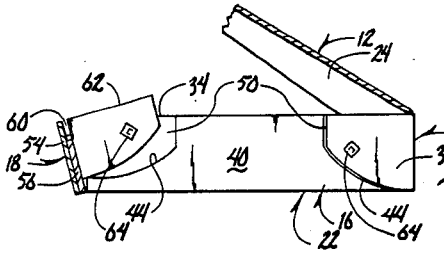
FIG. 4 is a sectional view taken along line 4—4 of FIG. 3, but showing the lid in an elevated position.
Figure 5:
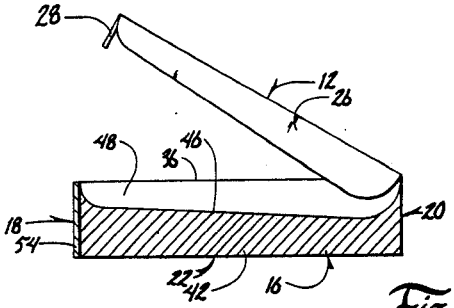
FIG. 5 is a sectional view taken along line 5—5 of FIG. 3, but showing the lid in an elevated position.
Figure 6:
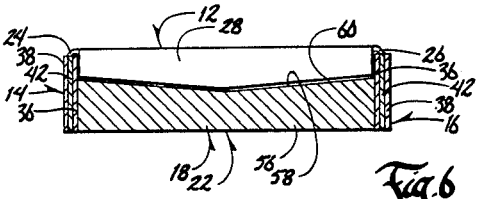
FIG. 6 is a sectional view taken along line 6—6 of FIG. 3.

To assemble the container into a rectangular box such as shown in FIG. 1, the side walls 14 are folded upwardly into a vertical position. Flaps 30, 32 of rear wall 20 are inserted into the interior slot 50, and similarly the flaps 61–62 of front wall 18 are slidably inserted into the slot 50. Top wall 12 is then folded downwardly with side flaps 24, 26 fitting within exterior slot 48 and with front flap 28 fitting within slot 60 of front wall 18. As can be seen in FIGS. 5 and 6, the cut-outs 46, 58 in spacer members 42, 56 are shaped to receive the flaps 26, 28 of top wall 12. Similarly, as can be seen in FIG. 4, the cut-outs 44 are shaped to matingly receive flaps 61, 62 and 30, 32.

A plurality of locking tabs 64 are used on central panel 36 and also on flaps 30, 32 and 61, 62 so as to insure the locking engagement of flaps 30, 32 and 61, 62 within slots 50. The locking tabs 64 are well known in the art, and various types of locking tabs can be used without detracting from the invention.

After the container 10 has been assembled into the shape shown in FIG. 1, it is secure and strong. During use, the box may be further secured by fastening tape along or across the upper corner seams of the box so as to insure that the box will not become unfolded. The box is extremely strong due to the double and triple panel thicknesses at the front and side walls of the box. The interior of the container is secure from being exposed to the exterior of the box. The box can be easily opened after usage by removing the tape from the seams. The box can then be unfolded in the reverse manner as described above. It can then be used additional times for shipping.

It is understood that the shape of the container is not limited to rectangular, but may be of any polygonal shape with interlocking flaps without departing from the scope of the present invention.

Thus, it can be seen that the device accomplishes at least all of its stated objectives.

What is claimed is:

1. A rectangular container comprising:

a rectangular bottom wall having a front edge, a rear edge, and a pair of opposite side edges;

a rear wall extending upwardly from said rear edge of said bottom wall, said rear wall comprising a single rectangular rear panel having opposite ends and a pair of rear flaps connected to said opposite ends of said rear panel;

a front wall comprising an inner front rectangular panel extending upwardly from said front edge of said bottom wall and an outer front rectangular panel, a front spacing means being between said inner and outer front panels, and securing them in spaced facing relation to one another;

said inner front panel having opposite ends, a pair of front flaps being connected to said opposite ends of said inner front panel;

a pair of opposite side walls extending upwardly from said opposite side edges of said bottom wall, each of said side walls comprising a central side panel, an inner side panel, and an outer side panel held in spaced relation to one another by a first side spacer means positioned between said inner and central side panels, and a second side spacer means positioned between said central side panel and said outer side panel;

a rectangular top wall having a rear edge connected to said rear wall, a front edge and two opposite side edges, a pair of top side flaps being connected to said opposite side edges of said top wall, and a third top flap being connected to said front edge of said top wall;

said rear flaps of said rear wall and said front flaps of said front wall being fitted within the spaces between said inner and central side panels of said opposite side walls;

said top side flaps of said top wall being fitted within the spaces between said central side panels and said outer side panels of said opposite side walls;

said top third flap being fitted within the space between said inner front wall and said outer front wall.

2. A rectangular container according to claim 1 wherein said bottom wall, said rear panel, said central panels of said opposite side walls, said inner panel of said front wall, and said top wall are of integral construction.

3. A rectangular container according to claim 1 wherein locking means secure said rear flaps of said rear wall and said front flaps of said front wall to said central panels of said opposite side walls.

4. A rectangular container according to claim 3 wherein said locking means comprise a first locking member attached to each of said front and rear flaps and a pair of second locking members attached to each of said central panels of said side walls, said first and second locking means retentively engaging one another when said front and rear flaps are fitted within the spaces between said inner and central side panels of said side walls.

5. A polygonal container comprising:

a polygonal bottom wall having a plurality of edges;

a rear wall extending upwardly from one of said edges of said bottom wall, said rear wall comprising a single rectangular rear panel having opposite ends and a pair of rear flaps connected to said opposite ends of said rear panel;

a front wall comprising an inner front rectangular panel extending upwardly from another of said edges of said bottom wall and an outer front rectangular panel, a front spacing means being between said inner and outer front panels, and securing them in spaced facing relation to one another;

said inner front panel having opposite ends, a pair of front flaps being connected to said opposite ends of said inner front panel;

side walls extending upwardly from the remaining of said edges of said bottom wall, each of said side walls comprising a central side panel, an inner side panel, and an outer side panel held in spaced relation to one another by a first side spacer means positioned between said inner and central side panels, and a second side spacer means positioned between said central side panel and said outer side panel;

a rectangular top wall having a rear edge connected to said rear wall, a front edge and a plurality of side edges, a top front flap being connected to said front edge of said top wall and top side flaps being connected to said side edges of said top wall;

said rear flaps of said rear wall and said front flaps of said front wall being fitted within the space between said inner and central side panels of said side walls adjacent thereto;

said top side flaps of said top wall being fitted within the spaces between said central side panels and said outer side panels of said side walls adjacent thereto;

said top front flap being fitted within the space between said inner front wall and said outer front wall.

6. A polygonal container according to claim 5 wherein said bottom wall, said central panels of said side walls, said top wall, said flaps of said top wall and said flaps of said side walls are of integral construction.

7. The polygonal container of claim 5 wherein two adjacent side walls are interconnected with one another.

* * * * *